United States Patent [19]

Hillberg

[11] 3,991,412

[45] Nov. 9, 1976

[54] MULTI-SUBSCRIBER ALARM SYSTEM WITH CENTRAL RECEIVING AND TRANSMITTING INSTALLATION

[76] Inventor: Arne Verner Hillberg, Engelbrektsgatan 4, S-803 54 Gavle, Sweden

[22] Filed: Feb. 14, 1975

[21] Appl. No.: 549,868

[30] Foreign Application Priority Data

Feb. 19, 1974 Sweden ..... 7402133

[52] U.S. Cl. ..... 340/213.2; 340/411

[51] Int. Cl.[2] ..... G08B 25/00

[58] Field of Search ..... 340/213 R, 213.1, 213.2, 340/216, 411

[56] References Cited

UNITED STATES PATENTS

| | | | |
|---|---|---|---|
| 3,430,218 | 2/1969 | Healey | 340/213 R |
| 3,707,708 | 12/1972 | Dan | 340/223.2 |
| 3,854,127 | 12/1974 | Damon | 340/213.2 |

*Primary Examiner*—Alvin H. Waring
*Attorney, Agent, or Firm*—Alfred E. Miller

[57] ABSTRACT

An alarm system for a number of individual subscribers connected to a central installation in which each subscriber can signal the central installation when help is needed and the central installation can signal back to the subscriber indicating receipt of the call. The subscriber can make further calls and receive signals from the central installation in return.

Alarm systems are known having multiple subscribers to a central processing station. These alarms are generally in use for burglar and fire protection. However, the equipment used in such installations are merely alarms from the subscriber to the station and do not have the possibility of a two-way contact between the individual subscribers and the central station.

6 Claims, 4 Drawing Figures

MULTI-SUBSCRIBER ALARM SYSTEM WITH CENTRAL RECEIVING AND TRANSMITTING INSTALLATION

The present invention relates to an alarm system which is particularly designed, but not limited thereto, for single people living alone, as well as disabled and other handicapped people.

It is an object of the present invention to provide an alarm construction and arrangement in which an individual subscriber and the central installation can exchange signals at will thereby providing better protection for the subscriber.

Another object of the present invention is to provide a unit in the central installation which measures the current condition on the subscriber line in order to detect short circuits therein. The invention will be more fully described with reference to the accompanying drawings, in which.

DESCRIPTION OF THE PREFERRED EMBODIMENT

Figure 1:
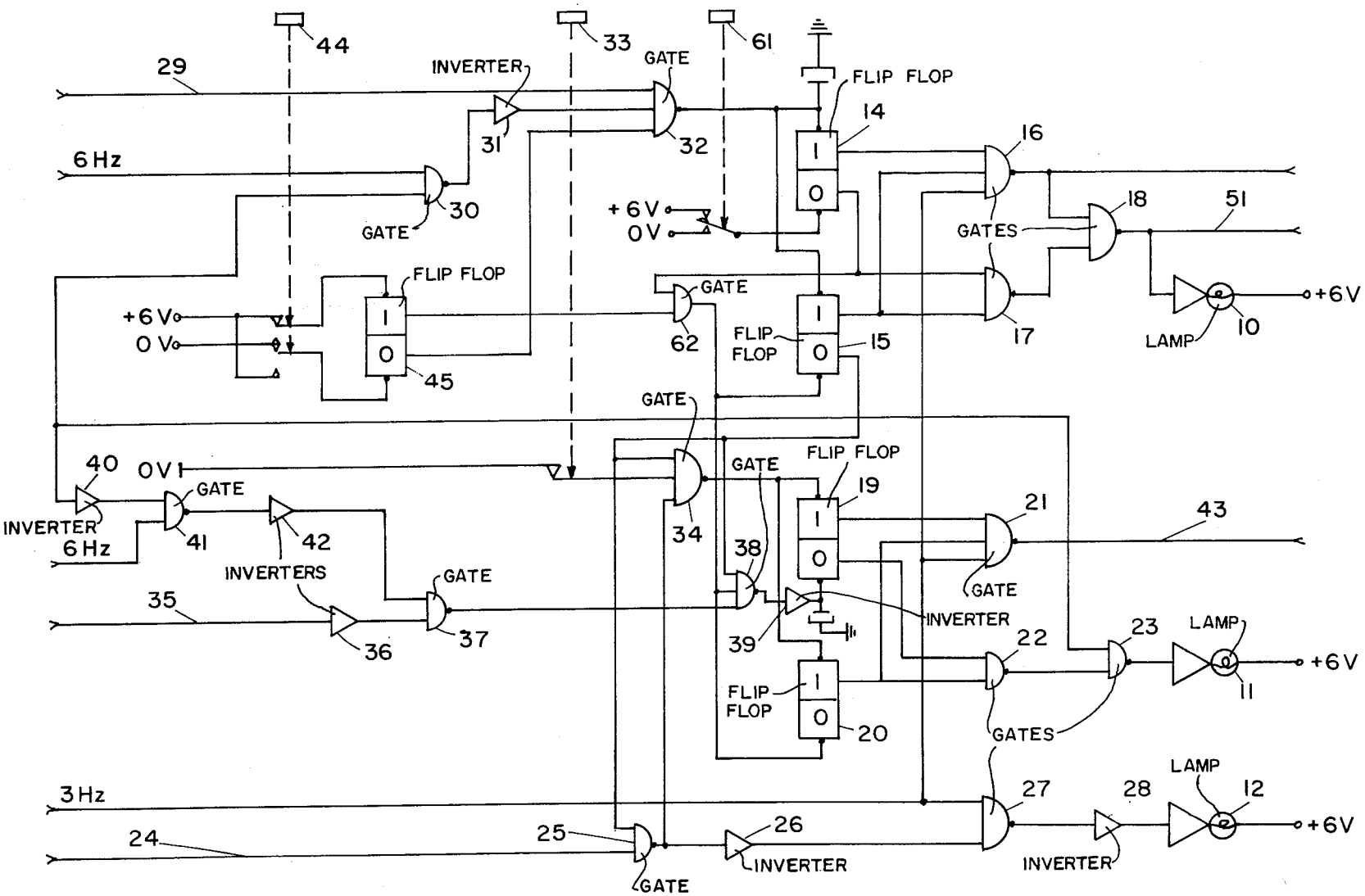
FIG. 1 is a circuit diagram of the alarm system including a logic unit in the central installation constructed and arranged in accordance with the teachings of the present invention.
Figure 2:
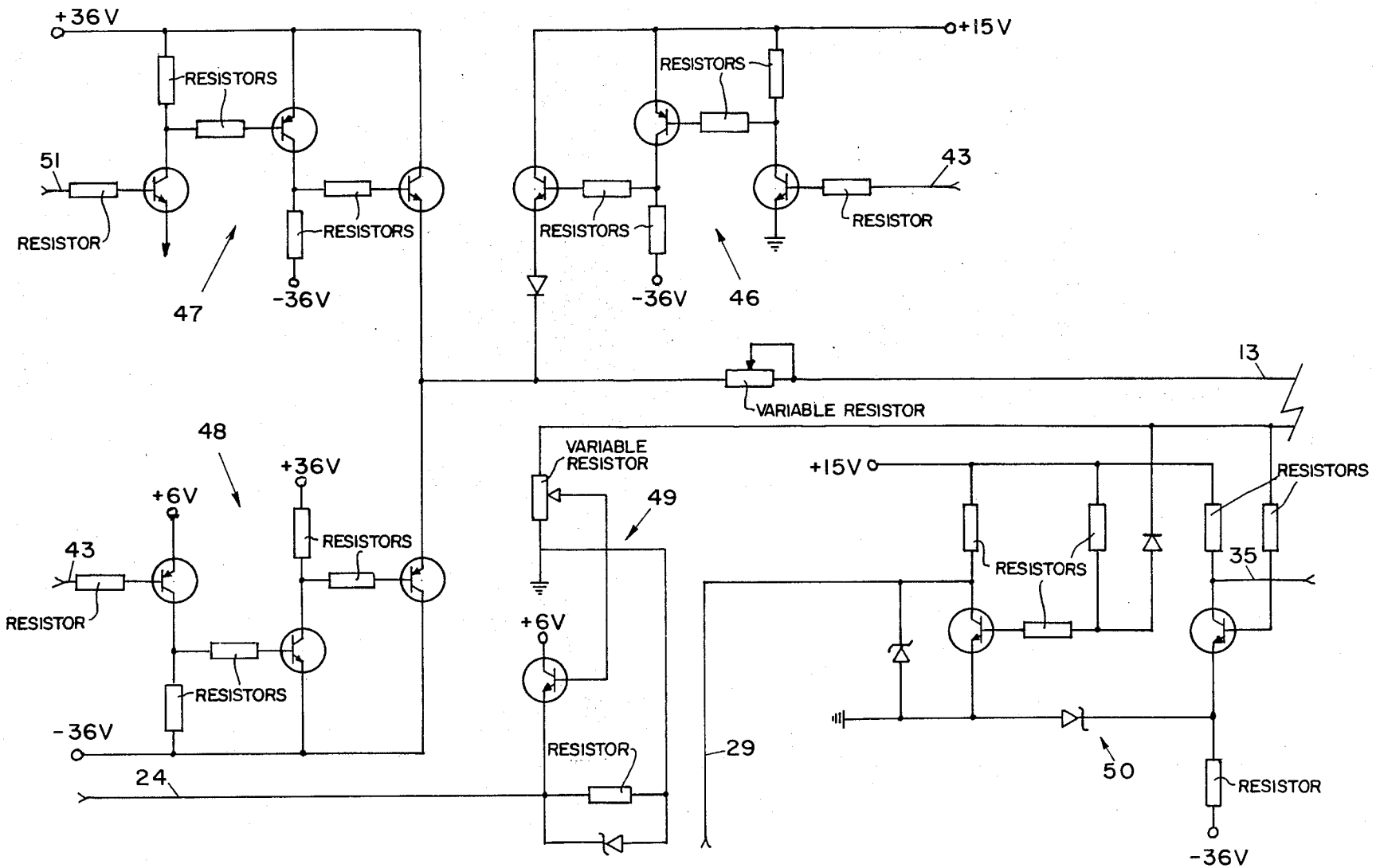
FIG. 2 is a circuit diagram including an interface unit connected between said logic unit and a subscriber unit.
Figure 3:
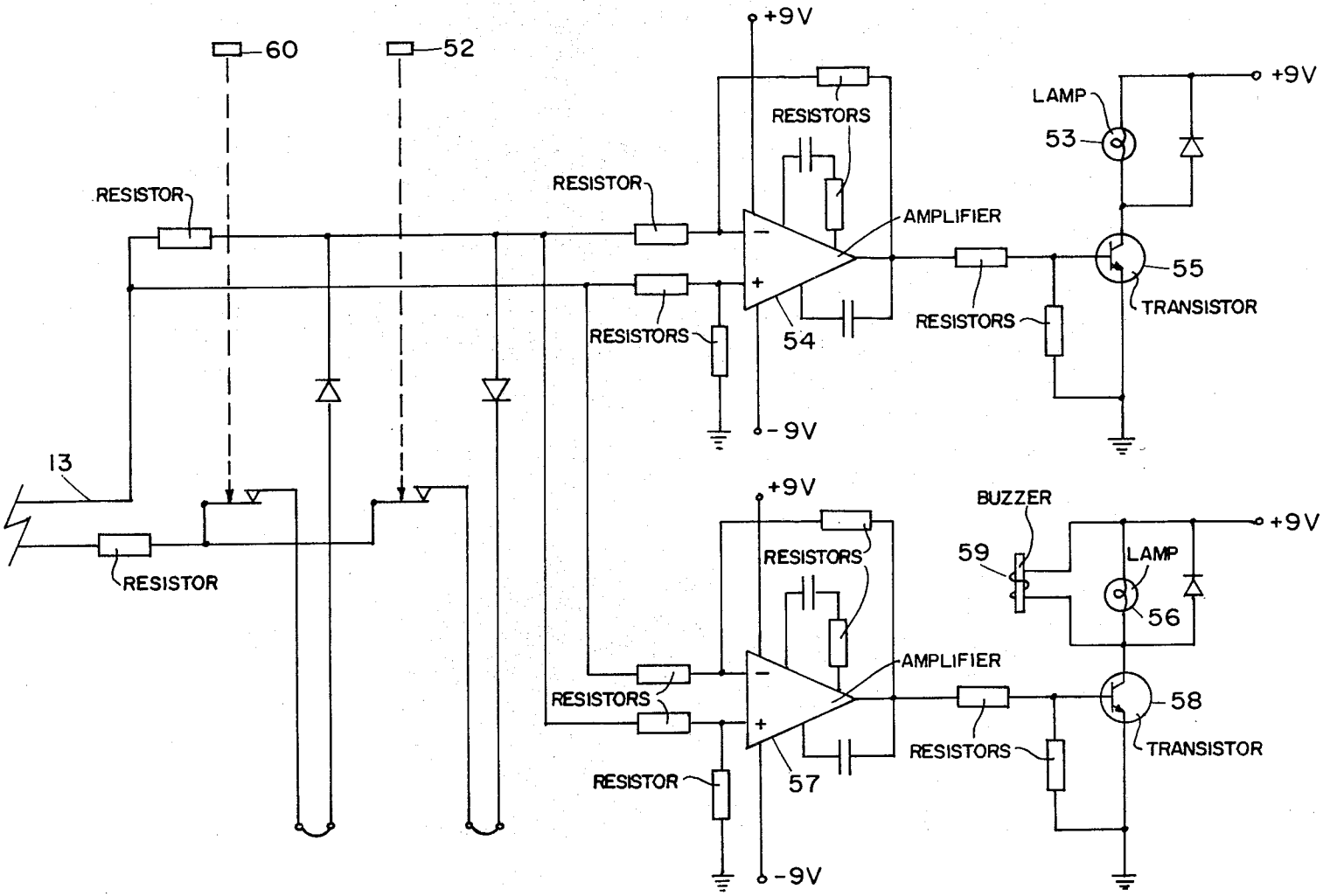
FIG. 3 is a circuit diagram including a subscriber unit.

As seen in FIG. 1, the logic unit of the circuit serves an alarm signal lamp 10, a call signal lamp 11 and furthermore the lamp 12 which functions to indicate short circuit faults on a two wire subscriber line which connects a subscriber to a central installation, and referred to in FIGS. 2 and 3 by the reference numeral 13.

It will be noted from FIG. 1 that the lamp 10 is controlled by two flip-flops 14 and 15 through gates 16. 17 and 18. Moreover, the lamp 11 is correspondingly controlled by two flip-flops 19 and 20 via gate 21, 22 and 23. The lamp 12 is controlled by signals placed on the conductor 24 through means of gates 25 and 27 and inverters 26 and 28.

In the above-described arrangement alarm signals are received by the logic unit on a conductor 29. The alarm signals by means of gates 30 and 32, inverter 31 control the flip-flops 14 and 15. A push button 61 is provided in the system for shutting off the alarm signals.

If it is desired to generate call signals the subscriber pushes the push button 33 thereby changing the condition on one input of the gate 34 connected to the flip-flop 19. The reply signal from the subscriber is received on a conductor 35 and transmitted by means of gates 37 and 38 and inverters 36 and 39 to the flip-flop 19. Signals are required for the gating of the answering signal which is transmitted to the gate 37 through gate 41 and inverters 40 and 42.

Two pulse trains of the frequencies 3 Hz and 6 Hz respectively are received from a pulse generator (not shown). These pulse trains are shown in both FIGS. 1 and 4 and are utilized to strobe those conductors over which signals are transferred to the logic unit and to generate suitable signals, for example flashing light to indicate certain conditions. As seen in FIG. 1, the pulse train of the frequency 3 Hz, for example, is transferred to the gate 21 to thereby create a call signal of this frequency on a conductor 43 which leads to the interface unit shown in FIG. 2.

A push button 44, as seen in FIG. 1, is used to reset all the flip-flops in the logic unit by which the flip-flop 45 can be reset. Furthermore, a conductor 51 is shown which is also connected to the interface unit illustrated in FIG. 2.

Referring now to FIG. 2 in which a circuit diagram is shown for an interface unit adapted to receive signals from the subscriber unit and transfer the received signals to the logic unit and furthermore to feed different voltage levels to the line 13. In order to accomplish this the interface unit includes three switches 46, 47 and 48 of which the switch 46 feeds the line with a low positive voltage level. The switch 47 feeds the line with a high positive voltage level and the switch 48 feeds the line with a high negative voltage level. For example, in the present embodiment the voltage levels are +15V, +36V and −36V respectively.

Each of the three switches 46, 47 and 48 comprise three transistors of which the input transistor isolates the logic unit from the higher supply voltage but emits a phase inverted amplified signal out of its collector. The middle transistor introduces another phase inversion and the third transistor, or output transistor is coupled as an emitter follower and feeds the line 13.

The interface unit shown in FIG. 2 comprises two further circuits of which one circuit 49 gives a short circuit indication on the conductor 24, and the other circuit 50 gives an alarm signal indication on conductor 29 to the logic unit (FIG. 1) and also an indication of stopping of the transmitted call signal on conductor 35 to the logic unit. Thus, the interface unit between the line 13 and the logic unit ensures the mutual adaptation of these units. It should be borne in mind that under the control of the logic unit the interface unit supplies signal currents of the desired magnitude and polarity to the line 13 for the control of the subscriber equipment. Furthermore, by measuring the current condition on the line 13 the interface unit transfers the signals from the subscriber's equipment to the logic unit.

FIG. 3 is a diagrammatic representation of a subscriber unit in which a push button 52 is utilized for generating an alarm signal by breaking the subscriber line 13. A lamp 53 is provided for indicating an alarm signal. Current is fed to the lamp 53 by means of a transistor 55 controlled by an amplifier 54. A lamp 56 is shown for indicating call signals to which current is fed by a transistor 58 controlled by an amplifier 57. It will also be noted that a buzzer 59 is shown connected in parallel to the lamp 56. In order to stop the call signals a push button 60 is provided.

It is desired to point out that a subscriber may have several subscriber units in his place of residence, which together form subscriber equipment. In this situation the control of the signal lamps and buzzers of the units is performed by a control unit (not shown) including an amplifier. Moreover, all push buttons of the same function belonging to a particular subscriber equipment are connected in series with each other. The subscriber equipment is supplied with current from rectifiers and is provided with a supply of dry cell batteries in reserve.

Figure 4:
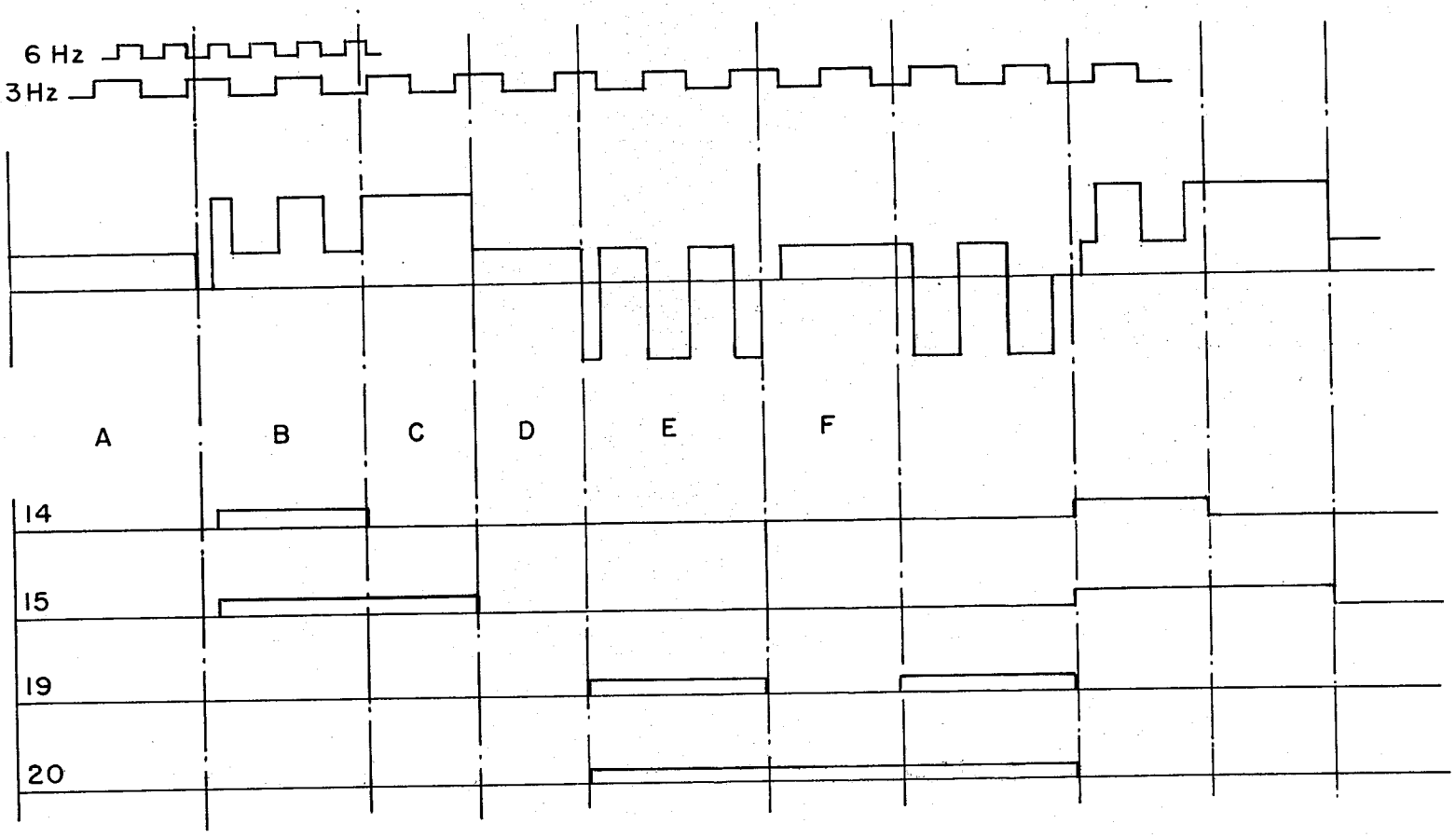
FIG. 4 is a graphical representation showing the current in a line connecting the central installation with the subscriber unit under various conditions and also the conditions of the flip-flops included in the logic unit.

The function of the present alarm system is now described in connection with several working conditions. In the rest condition of the system the line 13 carries a rest current as shown in FIG. 4 as area A. The rest current is generated by the circuit of switch 46 which supplies the line 13 with +15V. The circuit 49 measures the magnitude of the rest current and if the current should substantially increase, the circuit 49 gates a short circuit indication on conductor 24 to the logic unit. The lamp 12 is thereby activated to emit a yellow flashing light by means of gates 25 and 27 and inverters 26 and 28. Although call signals cannot be transmitted when there is an occurrence of a short circuit condition, a request for help can be noted however.

When an individual subscriber requires help, the push button 52 is pushed resulting in the break of the line 13. Meanwhile, the circuit 50 senses the change in the current condition on the line and emits an alarm signal on the conductor 29 to the logic unit. The alarm signal passes the gate 32 and sets the flip-flops 14 and 15, and a signal of the frequency 3 Hz is transmitted through gates 16 and 18 to the lamp 10 which is activated to emit, for example, a red flashing light. Moreover, the 3Hz frequency signal is also transmitted through conductor 51 to the switch 47 as shown in FIG. 2, which supplies the line 13 with a voltage of +36V at a frequency of 3Hz. This signal acts upon the amplifier 54 of the subscriber unit shown in FIG. 3, which in turn activates the transistor 55, so that the lamp 53 emits light in synchronism with the signal, for example a red flashing light. The latter flashing light indicates that the alarm signal has been received by the central installation. The line current during the alarm signal condition is shown in FIG. 4 as area B. An alarm signal indicating lamp can also be provided in an assembly alarm unit in the central installation. In that case, the assembly alarm unit includes all of the connected subscribers.

When a request for help has been received in the central installation, the push button 61 is depressed in order to stop the alarm signal. When this occurs the flip-flop 14 is reset and the signal coming through the gates 16 and 18 ceases and is replaced by a signal coming through the gates 17 and 18. Thereafter, the flashing red light of the lamp 10 of the central installation and the lamp 53 of the subscriber unit is replaced by a steady, uninterrupted light indicating that help is coming. Furthermore, the lamp in the assembly alarm unit goes out. If the subscriber is anxious to further expedite his call for help he can depress the push button 52 again and the lamps 10 and 53 will again emit a flashing red light. The stopping of the call signals can be achieved in the manner described hereinbefore, and the line current occurring during the stop signal is shown in FIG. 4 area C. It should be noted that the alarm signal cannot be stopped by a subscriber, but only by a staff member of the central installation.

After the system has been halted it may be reset by depressing the push button 44. The halting of the system resets the flip-flop 14 which results in one of two conditions for a gate 62, the second conditon of which is met by setting the flip-flop 45. When these conditions occur a signal is gated to flip-flop 15 for resetting the flip-flop and the lamps 10 and 53 are extinguished. The line current, after resetting, is shown in FIG. 4 as area D.

As seen in FIG. 1, call signals can be transmitted to a subscriber by depressing a push button 33 whereby the signal is transmitted via a gate 34 to flip-flops 19 and 20 thereby setting these flip-flops. The signal is transmitted through the gates 21, 22 and 23 for activating the lamp 11, which, for example emits a green light. Inasmuch as the signal of the frequency 3Hz controls gate 21 the lamp 11 will emit a flashing green light in synchronism with this signal. Furthermore, a signal of the frequency 3 Hz is also transmitted via conductor 43 to the interface unit which inactivates the switch 46 but activates the switch 48. The result is that on line 13 the voltage +15V is changed to −36V, and the latter voltage acts upon the amplifier 57 of the subscriber unit so that the transistor 58 is activated and the lamp 56 begins to emit a flashing light, which is preferably green. Thus, the lamp 56 will emit a flashing light of the same frequency as the lamp 11 in the central installaton unit. The current condition of the line is shown in area E of FIG. 4.

When the subscriber has observed the call from the central installation he stops the call signal by depressing the push button 60 so that the line 13 is interrupted and the circuit 50 of the interface unit will emit a signal on conductor 35 to the logic unit. This signal is gated via gates 37 and 38 and inverters 36 and 39 to the flip-flop 19, resetting this flip-flop. Thereafter, the signal path through gates 21 and 23 to the lamp 11 is thereby replaced by a signal path through gates 22 and 23. This results in the lamp 11 changing to emit a steady green light. Moreover, the signal on the conductor 43 changes its character so that the lamp 56 of the subscriber unit changes also to emit a steady green light.

If the push button 44 is depressed a resetting condition can be effected as described hereinabove whereby all lamps are extinguished. The current condition on line 13, after resetting, is shown in FIG. 4 as area F.

It should be apparent from the foregoing disclosure that the present alarm system is particularly suitable, because of its intercommunication possibilities, for single living individuals, as well as for disabled persons.

What is claimed is:

1. A multi-subscriber alarm system comprising: a central receiving and transmitting installation; a two wire line connecting each subscriber to said central installation; a central unit in said central installation having signal emitting means and signal indicating means for call signals to each of the subscribers; said central unit further being provided with signal indicating means for alarm signals from each subscriber and means for ceasing said alarm signals; each of said subscribers having at least one subscriber unit including an alarm signal emitting means, an alarm signal indicating means, call signal indicating means, and a call signal stopping means; and said system upon the receipt of an alarm signal in the central unit and simultaneously with the activation of said alarm signal indicating means includes separate means including a logic unit and an interface unit, the latter being connected between said line and said logic unit and being dependent upon signals received from said interface unit and activating said alarm signal indicating means and said call signal means, respectively, of a selected subscriber unit, said logic unit in dependence upon signals generated by said means for ceasing said alarm signals and said call signal emitting means, respectively, controls said interface unit for supplying said line with suitable signals for operating said alarm signal indicating means and said call signal indicating means, respectively, of said subscriber unit.

2. The alarm system as claimed in claim 1 wherein said line is normally provided with a rest current, and the operation of said alarm signal emitting means by a subscriber causes an interruption of said line whereby said signal emitting means in said central unit is activated to emit a signal for activating said alarm signal indicating means of said central unit.

3. The alarm system as claimed in claim 1 further comprising control means for said central unit which by measuring the current condition on the line detects short circuit faults thereon.

4. A multi-subscriber alarm system as claimed in claim 1 wherein said interface unit feeds said line with a voltage of a first level and a first polarity for making possible the indication of call signals from the subscriber unit, said interface unit feeding said line with a voltage of a second level higher than said first level and polarity for emitting ceasing signals to the subscriber unit, and said interface unit feeds said line with a voltage of a third level and of an opposite polarity for emitting call signals to said subscriber unit.

5. An alarm system according to claim 4 wherein the call signals from the subscriber unit are caused by a break of the line which is detected by the interface unit.

6. An alarm system according to claim 2 wherein the system is such that upon detection of a call signal from the subscriber unit by the interface unit the logic unit controls the interface unit to feed the line with an automatic ceasing signal informing the subscriber unit of the call signal having reached the central unit.

* * * * *